US005273794A

United States Patent [19]

Engel

[11] Patent Number: 5,273,794

[45] Date of Patent: Dec. 28, 1993

[54] DISPLAY CONTAINER

[76] Inventor: Peter Engel, 7402 N. Bell Rd., Milwaukee, Wis. 53223

[21] Appl. No.: 743,459

[22] Filed: Aug. 9, 1991

[51] Int. Cl.[5] ..... A47G 33/08

[52] U.S. Cl. ..... 428/11; 428/13; 428/34.1

[58] Field of Search ..... 40/410, 574; 428/7, 428/11, 13, 34.1; 215/2, 227, 354

[56] References Cited

U.S. PATENT DOCUMENTS

| | | | |
|---|---|---|---|
| 2,353,853 | 7/1944 | Sayford | 428/11 |
| 2,519,248 | 8/1950 | Hulbert | 428/11 X |
| 2,742,725 | 4/1956 | Esposito, Jr. | 428/11 X |
| 3,440,128 | 4/1969 | Kubilius | 428/13 X |
| 3,694,648 | 9/1972 | Yates | 428/11 X |
| 4,309,464 | 1/1982 | Rauch | 428/11 |
| 4,510,189 | 4/1985 | Girard | 428/19 |
| 4,592,936 | 6/1986 | Ferguson | 428/11 |
| 4,771,902 | 9/1988 | Teng | 40/410 X |
| 4,837,955 | 6/1989 | Grabhorn | 40/214 |
| 4,860,477 | 8/1989 | Gooch | 428/11 X |
| 4,889,748 | 12/1989 | Dudley | 428/11 |
| 4,923,721 | 5/1990 | Gilmore | 428/11 |
| 4,961,276 | 10/1990 | Lin | 40/410 |
| 5,082,699 | 1/1992 | Landau | 428/34.1 X |

*Primary Examiner*—Henry F. Epstein
*Attorney, Agent, or Firm*—Robert D. Thompson

[57] ABSTRACT

The present invention relates to a card display container suitable for use in displaying gift items or greeting cards containing sentimental messages or artistic renderings. The card display container comprises a transparent hollow spherical housing a card inside the spherical housing which contacts the inner surface of the spherical housing at the corners of the card, and an opening for insertion of the greeting card or gift item. The opening in the housing is closed by means of a plug. The plug may follow the exterior contour of the spherical housing or extend beyond the exterior surface of the spherical housing to form a flat surface thereby providing a base for the display container to rest on any flat surface such as a desk or shelf. The ornamental display container may also be displayed by hanging. The present invention provides a means for displaying gift items or cards containing sentimental messages or artistic renderings which can be viewed from almost any angle. The gift items or display cards may be easily placed in or removed from the container.

19 Claims, 2 Drawing Sheets

DISPLAY CONTAINER

BACKGROUND OF THE INVENTION

The present invention relates to ornamental articles which display a sentimental message, artistic rendering or the like or serve as an attractive container for gift-type items. Ornamental display devices for displaying two and three dimensional elements have long been known. Familiar examples are Christmas tree ornaments. The devices known to date however, while they display a message or a picture or a gift item, do not permit the easy changing of the message, picture or gift article. Those that do permit the changing of the displayed item require partial or complete disassembly of the display device to do so. Others which require or use illumination to properly view the displayed element require that separate apparatus be included for holding the message, picture or gift item in a fixed position from which it can be viewed through an aperture in the surface of the device or require that the device be opened to view the displayed element.

It is therefore an object of this invention to provide a display container that allows for easy interchange of the greeting cards without disassembly of the device and that affords clear and easy viewing of the greeting cards from practically any position outside the container.

Additional objects and advantages of this invention will become apparent from the following description and claims in conjunction with the drawings.

BRIEF SUMMARY OF THE INVENTION

This invention provides an ornamental display container for the display of written or pictorial presentations on paper or cardboard or gift items. The ornamental display container can be fabricated of a transparent material in a form and size sufficient to hold and display cards presenting written or pictorial expressions in a size up to the size of a conventional greeting card or small gift items. The use of an iridescent transparent material in the fabrication of the container adds a rainbow halo effect or the use of a tinted transparent material changes the shading of the displayed element, both effects which are achieved while maintaining the capability of reading the displayed message or observing the displayed element from almost any angle. The iridescent material adds to the colors which may be incorporated in the greeting card. The container may be of any size up to a size suitable to accommodate a conventional greeting card. It is anticipated that the most common application would include the use of a card with an unfolded size of approximately 4¼ inches wide by 2½ inches high displaying a colorful design and/or a sentimental message. The sizing of the card would depend upon the sizing of the ornamental display container or vice versa but it is anticipated that the most common embodiment of the invention would be by way of a spherical container 3½ inches in diameter. Access to the interior of the ornamental display container is obtained by way of an opening in the container. It is anticipated that the opening would generally be located at the bottom of the container as that container would be oriented for viewing the displayed element. Once the card is inserted, it is held generally in position by way of the pressure of the edges and sides of the card against the interior surface of the container. A card may be folded to increase the size of the viewing area on the card. An added advantage of this invention is that it enables the viewer to have an area view of almost 360 degrees to observe the card or gift item inserted inside the container. The opening through which the card is inserted, following insertion of the card, is closed by means of a plug of pliable/flexible material which then seals the opening of the container. In one embodiment of the invention, the plug also serves as a base for the container providing a flat surface which can be rested upon the top of a table, shelves, display case, etc. for viewing the card inside the container. Another embodiment of the invention would include a hook or string-like apparatus for hanging the card display container from a bracket, Christmas tree or other extension from a vertical surface.

BRIEF DESCRIPTION OF SEVERAL VIEWS OF THE DRAWINGS

A more complete understanding of the invention and its advantages will be apparent from the detailed description taken in conjunction with the accompanying drawings in which.

DETAILED DESCRIPTION

Figure 1:
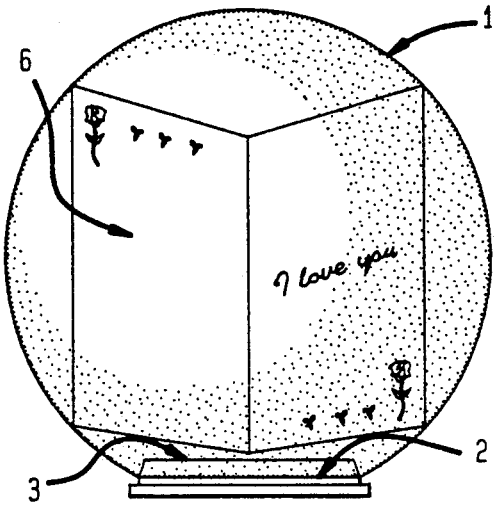
FIG. 1 is a schematic front view of the apparatus.
Figure 2:
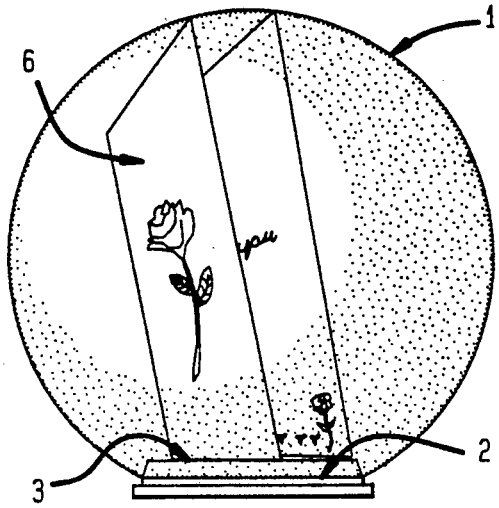
FIG. 2 is a schematic side view of the apparatus.
Figure 3:
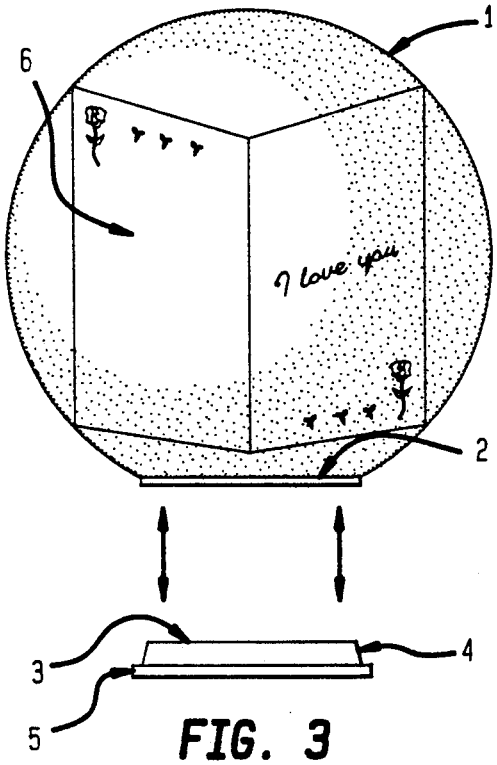
FIG. 3 is a schematic exploded view of the apparatus.
Figure 4:
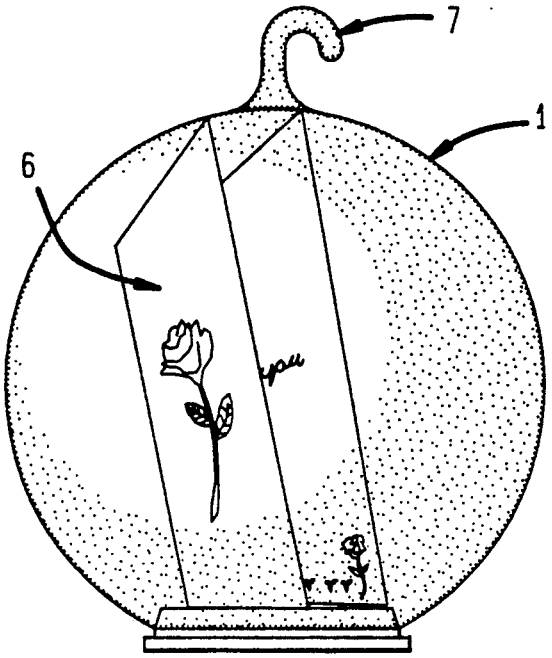
FIG. 4 is a schematic side view of the apparatus showing an embodiment with a hook at the top for attaching the apparatus to a bracket or other horizontal extension.
Figure 5:
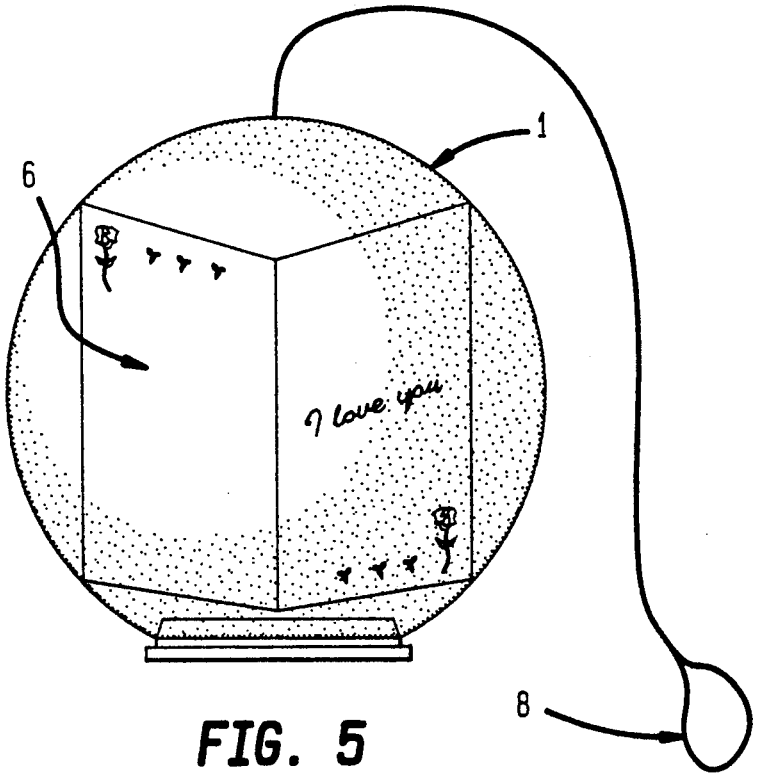
FIG. 5 is a schematic front view of the apparatus showing an embodiment with a string-like apparatus for hanging the ornamental display.

Referring more specifically to the drawings, the apparatus includes a card display container having a hollow housing 1. The housing is generally spherical or ball-like. It can be of any size but typically it has a diameter of three to four inches. The spherical housing 1 has an opening in its bottom 2. The opening 2 may be of any shape and large enough to permit the insertion of the greeting card 6 which may be folded or unfolded and display a sentimental message or artistic rendering or be a small gift item. The card is held in place by the pressure of the edges and sides of the card against the interior surface of the spherical housing 1. The opening is closed by a plug 3 made of a pliable material and comprising an inner vertical edge 4 forming a shape of the same size as the opening 2 and an outer vertical edge 5 forming a shape similar to the opening 2 but with dimensions approximately ⅛ inch greater than the opening 2. The inner edge 4 of the plug fits into the opening 2 thus forming a friction fit which will keep the plug 3 in place in the opening 2 unless force is applied. The bottom outer surface of the plug 3 is flat providing a surface which will rest on any other flat surface thereby making the card display container stable in a vertical position.

A further modification of this embodiment is to provide hanging means which may comprise a hook 7 formed or attached to the top of the container or a hanger 8 having a loop and connected to the top of the container 1. This will allow the card display container to hand or be suspended from some type of stand or a Christmas tree. In this embodiment, the bottom outer surface of the plug 3 may follow the contour of the spherical housing 1.

The ornamental display container can be made of any transparent material which can be formed into a spherical or ball-like housing. An additional and very complimentary effect is obtained through the use of a transparent material having iridescent properties which add a rainbow or halo effect to the housing while not detracting from the capability of the observer to view the displayed card 6. Similarly, the use of a transparent material having a color tint may add to the effect of the displayed card 6 while not reducing the field of observation of the element.

Many modifications can be made in the exemplary structure described above without exceeding the scope of the present invention. While certain embodiments of the present invention have been described in detail herein and shown in the accompanying drawings, it is obvious that minor changes may be made in the form and construction of the invention without departing from the material spirit thereof.

What is claimed is:

1. A card display container which comprises a transparent, hollow, spherical housing having an opening for providing access to the inner portion of said housing, a card displaying a sentimental message or artistic rendering inside the spherical housing which contacts the inner surface of the spherical housing at the corners of the card, and a plug for providing cover over the aforesaid opening.

2. The card display container of claim 1 which further comprises hanging means connected to said housing for displaying said object and a plug whose outer surface follows the contour of the spherical housing.

3. The card display container of claim 1 wherein said plug extends from the opening at the bottom of the spherical housing, said extension of the plug forming a flat surface over the aforesaid opening in the sphere.

4. The card display container of claim 3 wherein said plug is made of a transparent material.

5. The card display container of claim 3 wherein said plug is made of an opaque material.

6. A card display container which comprises an iridescent transparent hollow spherical housing having an opening for providing access to the inner portion of said housing, a card displaying a sentimental message or artistic rendering inside the spherical housing which contacts the inner surface of the spherical housing at the corners of the card, and a plug for providing cover over the aforesaid opening.

7. The card display container of claim 6 which further comprises hanging means connected to said housing for displaying said object and a plug whose outer surface follows the contour of the spherical housing.

8. The card display container of claim 6 wherein said plug extends from the opening at the bottom of the housing said extension of the plug forming a flat surface over the aforesaid opening in the spherical housing.

9. The card display container of claim 8 wherein said plug is made of an opaque material.

10. The card display container of claim 8 wherein said plug is made of a transparent material.

11. The card display container of claim 8 wherein said plug is made of an iridescent transparent material.

12. A card display container which comprises a tinted transparent hollow spherical housing having an opening for providing access to the inner portion of said housing, a card displaying a sentimental message or artistic rendering inside the spherical housing which contacts the inner surface of the spherical housing at the corners of the card, and a plug for providing cover over the aforesaid opening.

13. The card display container of claim 12 which further comprises hanging means connected to said housing for displaying said object and a plug whose outer surface follows the contour of the spherical housing.

14. The card display container of claim 12, wherein said plug extends from the opening at the bottom of the housing said extension of the plug forming a flat surface over the aforesaid opening in the spherical housing.

15. The card display container of claim 14 wherein said plug is made of an opaque material.

16. The card display container of claim 14 wherein said plug is made of a tinted transparent material.

17. A card display container which comprises a tinted transparent hollow spherical hosing having an opening for providing access to the inner portion of said housing and a display element which comprises a thin, stiff-backed member having a front surface and a back surface, said member being of a size such that it will fit into the interior of the hollow spherical housing and be engaged at its edges and sides by the interior surface of the hollow spherical housing.

18. A card display container which comprises a transparent, hollow spherical housing having an opening for providing access to the inner portion of said hosing and a display element which comprises a thin, stiff-backed member having a front surface and a back surface, said member being of a size such that it will fit into the interior of the hollow spherical housing and be engaged at its edges and sides by the interior surface of the hollow spherical housing.

19. A card display container which comprises an iridescent transparent hollow spherical housing having an opening for providing access to the inner portion of said housing and a display element which comprises a thin stiff-backed member having a front surface and a back surface, said member being of a size such that it will fit into the interior of the hollow spherical housing and be engaged at its edges and sides by the interior surface of the hollow spherical housing.

* * * * *